US010308393B2

(12) United States Patent
Montoya

(10) Patent No.: US 10,308,393 B2
(45) Date of Patent: Jun. 4, 2019

(54) RECONFIGURABLE FIXTURES

(71) Applicants: SONY CORPORATION, Tokyo (JP); Sony Pictures Entertainment Inc., Culver City, CA (US)

(72) Inventor: Cesar Montoya, Los Angeles, CA (US)

(73) Assignees: SONY CORPORATION, Tokyo (JP); SONY PICTURES ENTERTAINMENT INC., Culver, CA (US)

( * ) Notice: Subject to any disclaimer, the term of this patent is extended or adjusted under 35 U.S.C. 154(b) by 0 days.

(21) Appl. No.: 15/072,233

(22) Filed: Mar. 16, 2016

(65) Prior Publication Data

US 2017/0267403 A1 Sep. 21, 2017

(51) Int. Cl.

| | |
|---|---|
| ***B65D 21/02*** | (2006.01) |
| ***B65D 85/00*** | (2006.01) |
| ***B65D 25/20*** | (2006.01) |
| ***G09F 15/00*** | (2006.01) |
| ***G09F 1/00*** | (2006.01) |
| ***G09F 1/06*** | (2006.01) |

(52) U.S. Cl.

CPC ..... *B65D 21/0205* (2013.01); *B65D 25/20* (2013.01); *B65D 85/70* (2013.01); *G09F 1/00* (2013.01); *G09F 1/06* (2013.01); *G09F 15/0068* (2013.01)

(58) Field of Classification Search

CPC ..... B65D 5/425; B65D 21/0205; B32B 31/00
USPC ..... 156/226; 206/386, 459.5
See application file for complete search history.

(56) References Cited

U.S. PATENT DOCUMENTS

| | | | | |
|---|---|---|---|---|
| 5,895,540 | A * | 4/1999 | David | B65B 17/02 156/226 |
| 8,770,587 | B2 | 7/2014 | Diercks | |
| 2006/0283924 | A1 | 12/2006 | McDaniel, Jr. et al. | |
| 2014/0262889 | A1 * | 9/2014 | Wahrmund | B65G 57/22 206/386 |

FOREIGN PATENT DOCUMENTS

| | | | |
|---|---|---|---|
| WO | 2009061505 | A1 | 5/2009 |

* cited by examiner

*Primary Examiner* — Anthony D Stashick
*Assistant Examiner* — Raven Collins
(74) *Attorney, Agent, or Firm* — Procopio, Cory, Hargreaves & Savitch LLP

(57) ABSTRACT

Module for playing a plurality of promotions, including: a plurality of fixtures sequentially configurable into the plurality of promotions by rotating at least one fixture while maintaining an original position of each fixture within the reconfigurable module, each fixture including a plurality of sides; and a plurality of fasteners to combine the plurality of fixtures into the reconfigurable module. Key words include corrugate, modular, and rotate.

16 Claims, 7 Drawing Sheets

RECONFIGURABLE FIXTURES

BACKGROUND

Field of the Disclosure

The present disclosure relates to reconfigurable fixtures, and more specifically, to reconfigurable fixtures for displaying multiple promotions.

Background

Typically, retail corrugate fixtures are used to run a single promotion by using the front face of the fixtures. At the end of the promotion, the fixtures are removed and discarded. For example, FIG. 1 shows a conventional retail corrugate fixture arranged with one side 102 of the fixture 100 (e.g., a box) to form a single promotion. FIG. 2 shows another conventional retail corrugate fixture arranged with two sides 112, 114 of the fixture 110 to form a single promotion. By extension, three or more sides can be used to form a single promotion.

FIGS. 3 and 4 are top views of the conventional retail corrugate fixtures corresponding to the arrangements of FIGS. 1 and 2, respectively. FIG. 3 shows the top view of the fixture arranged with one side 102 of the fixture 100 to form a single promotion. FIG. 4 shows the top view of the fixture arranged with two sides 112, 114 of the fixture 110 to form a single promotion.

SUMMARY

The present disclosure provides for displaying multiple promotions using reconfigurable fixtures.

In one implementation, a reconfigurable module for displaying a plurality of promotions is disclosed. The reconfigurable module includes: a plurality of fixtures sequentially configurable into the plurality of promotions by rotating at least one fixture while maintaining an original position of each fixture within the reconfigurable module, each fixture including a plurality of sides; and a plurality of fasteners to combine the plurality of fixtures into the reconfigurable module.

In another implementation, a module reconfigurable from a first promotion to a second promotion is disclosed. The module includes: a plurality of fixtures sequentially reconfigurable from the first promotion to the second promotion by rotating at least one fixture, wherein a position of each fixture within the module is maintained from the first promotion to the second promotion; and a plurality of fasteners to couple the plurality of fixtures together in the first promotion and the second promotion.

In another implementation, a method of reconfiguring a plurality of fixtures to display multiple promotions is disclosed. The method includes: combining the plurality of fixtures into a modular unit using fasteners to form a first promotion; detaching the fasteners when a predetermined amount of time has elapsed; and rotating at least one fixture of the plurality of fixtures of the first promotion such that different sides of the plurality of fixtures are visible.

Other features and advantages of the present disclosure should be apparent from the present description which illustrates, by way of example, aspects of the disclosure.

BRIEF DESCRIPTION OF THE DRAWINGS

The details of the present disclosure, both as to its structure and operation, may be gleaned in part by study of the appended further drawings, in which like reference numerals refer to like parts, and in which.

DETAILED DESCRIPTION

As described above, retail corrugate fixtures are used to run a single promotion by using the front face of the fixtures. At the end of the promotion, the fixtures are removed and discarded. Accordingly, there are needs for fixture configurations that can be used for multiple promotions.

After reading this description it will become apparent how to implement the disclosure in various implementations and applications. Although various implementations of the present disclosure will be described herein, it is understood that these implementations are presented by way of example only, and not limitation. As such, this detailed description of various implementations should not be construed to limit the scope or breadth of the present disclosure.

In one implementation, by redesigning the fixtures to take advantage of multiple sides of each fixture and combining the fixtures to form a modular unit, the fixtures can be made to run multiple promotions. In one implementation, a fixture is a box containing the media of a movie being promoted. In another implementation, a fixture includes multiple promotions (illustrated on multiple sides) including the promotion for the movie contained in the fixture. In yet another implementation, a fixture is a retail corrugate stand displaying multiple promotions on multiple sides. In yet another implementation, the fixtures of a modular unit are coupled with fasteners (attachment or fastening means) including tapes, ridges, holes, Velcro pads, hooks, tabs, pins, etc. In a further implementation, each fixture of the modular unit is configured to be rotatable such that different sides of the fixture are visible after the rotation.

Thus, in one implementation, fixtures are combined into a modular unit using fasteners to form a first promotion which is displayed for a predetermined period of time. After the predetermined period of time has elapsed, the fasteners are detached and the fixtures of the first promotion are rotated (without having to significantly move the center of rotation of each fixture) so that different sides of the fixtures are visible. The rotation of the fixture is configured so that the center of rotation does not have to be moved significantly. Thus, the term "not . . . significantly" refers to a movement within a limited space in which the promotion is being displayed. Further, the change in configuration from the first promotion to the second promotion is such that the position of each fixture within the first or second promotion is made to remain constant. This enables the change in configuration to be made without having to shuffle the fixtures in a limited space. The rotated fixtures are then combined again with the fasteners into another modular unit to form a second promotion.

Figure 1:
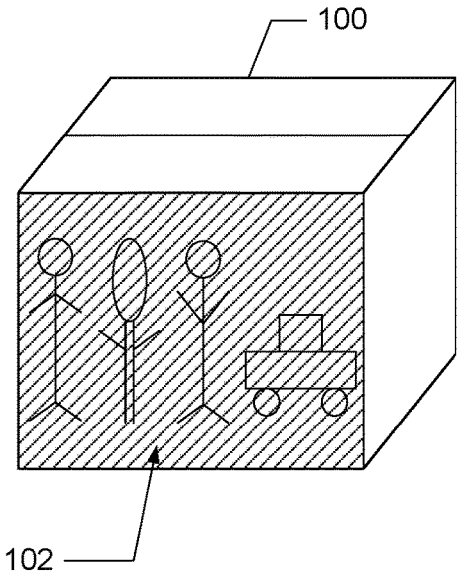
FIG. 1 (PRIOR ART)
FIG. 1 shows a conventional retail corrugate fixture arranged with one side of the fixture to form a single promotion.
Figure 2:
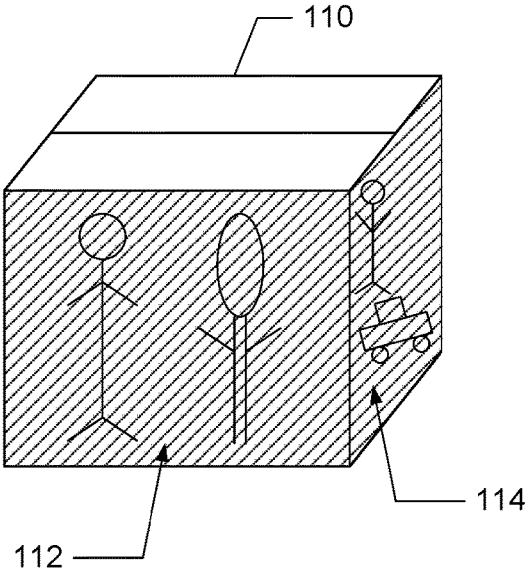
FIG. 2 (PRIOR ART)
FIG. 2 shows another conventional retail corrugate fixture arranged with two sides of the fixture to form a single promotion.
Figure 3:
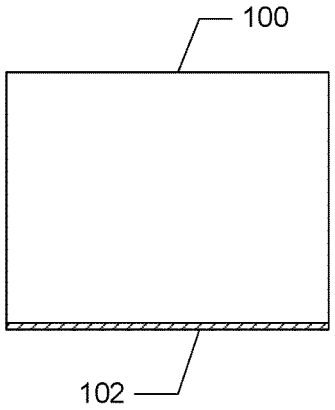
FIG. 3 (PRIOR ART)
FIG. 3 shows the top view of the fixture arranged with one side of the fixture to form a single promotion.
Figure 4:
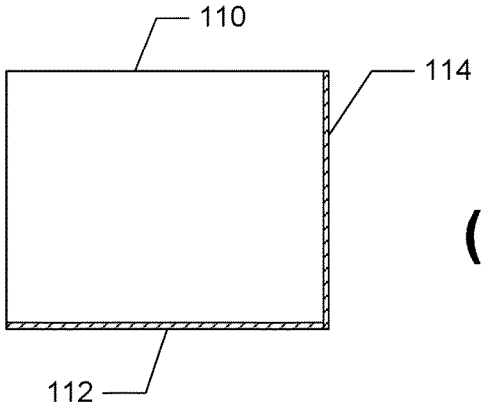
FIG. 4 (PRIOR ART)
FIG. 4 shows the top view of the fixture arranged with two sides of the fixture to form a single promotion.
Figure 5A:
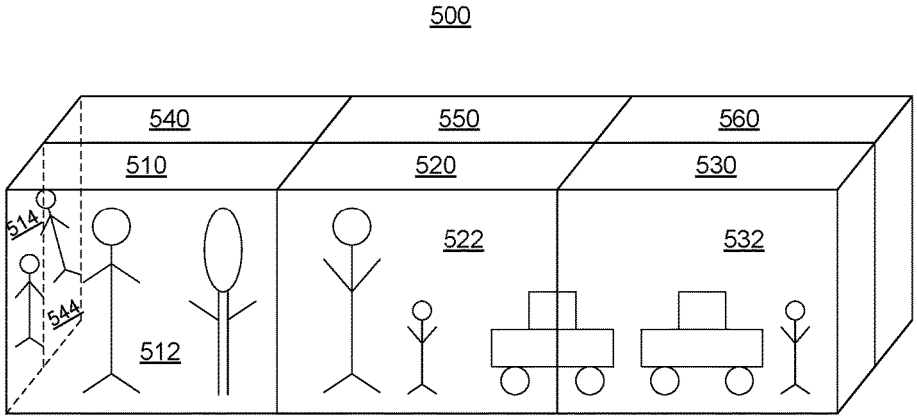
FIG. 5A is a functional diagram of a modular promotional unit formed with multiple fixtures in accordance with one implementation of the present disclosure.

FIG. 5A is a functional diagram of a modular promotional unit 500 formed with multiple fixtures 510, 520, 530, 540, 550, 560 in accordance with one implementation of the present disclosure. In the illustrated implementation of FIG. 5A, the modular unit 500 displays each promotion on two panels. The first panel is formed with sides 512, 522, 532 of fixtures 510, 520, 530, respectively. The second panel is formed with sides 514, 544 of fixtures 510, 540, respectively.

Figure 5B:
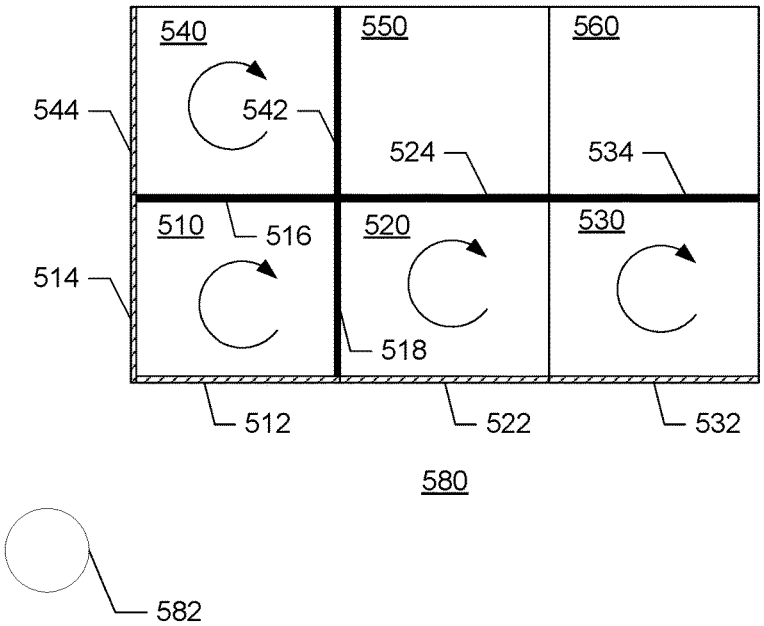
FIG. 5B shows a top view of a first promotion which includes two panels with certain sides visible.

FIG. 5B shows a top view of a first promotion 580 which includes two panels with sides 512, 522, 532, 514, 544 visible. In FIG. 5B, fixtures 520, 530, 540 use two sides, one for each promotion. Fixture 520 uses side 522 for the first promotion and side 524 for the second promotion. Fixture 530 uses side 532 for the first promotion and side 534 for the second promotion. Fixture 540 uses side 544 for the first promotion and side 542 for the second promotion. Further, in FIG. 5B, fixture 510 uses four sides, two for each promotion. Sides 512, 514 are used for the first promotion, while sides 516, 518 are used for the second promotion. Thus, for a viewer 582 standing near the corner of the two panels, sides 512, 522, 532 comprise a front-facing panel, while sides 514, 544 comprise a side-facing panel.

Figure 5C:
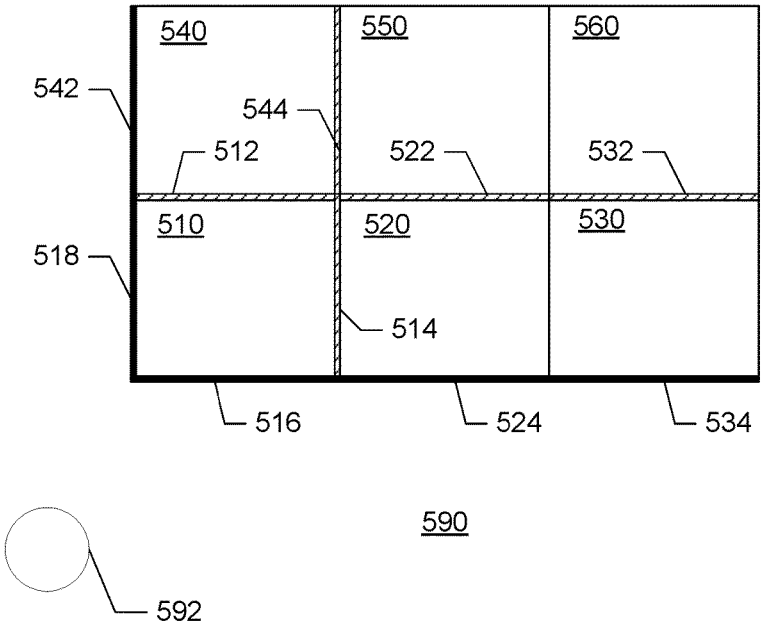
FIG. 5C shows a top view of a second promotion which includes two panels with different sides visible.

FIG. 5C shows a top view of a second promotion 590 which includes two panels with sides 516, 524, 534, 518, 542 visible. Thus, for a viewer 592 standing near the corner of the two panels, sides 516, 524, 534 comprise a front-facing panel, while sides 518, 542 comprise a side-facing panel.

To convert the first promotion 580 to the second promotion 590, fixtures 510, 520, 530, 540 are rotated 180 degrees. Fixture 520 is rotated 180 degrees so that side 522, which was visible in FIG. 5B as part of the front-facing panel is hidden in FIG. 5C, while side 524, which was hidden in FIG. 5B, is shown in FIG. 5C as part of the front-facing panel. Fixture 530 is rotated 180 degrees so that side 532, which was visible in FIG. 5B as part of the front-facing panel is hidden in FIG. 5C, while side 534, which was hidden in FIG. 5B, is shown as part of the front-facing panel in FIG. 5C. Fixture 540 is rotated 180 degrees so that side 544, which was visible in FIG. 5B as part of the side-facing panel is hidden in FIG. 5C, while side 542, which was hidden in FIG. 5B, is shown in FIG. 5C as part of the side-facing panel. Fixture 510 is rotated 180 degrees so that sides 512, 514, which were visible in FIG. 5B as part of the front-facing (512) and side-facing (514) panels are hidden in FIG. 5C, while sides 516, 518, which were hidden in FIG. 5B, are shown in FIG. 5C as part of the front-facing 516 and side-facing 518 panels.

It should be noted that while converting from the first promotion of FIG. 5B to the second promotion of FIG. 5C, the position of each fixture within the modular promotional unit 580, 590 is fixed. For example, the position of fixture 510 is fixed at front left side, while the position of fixture 520 is fixed at front middle of the unit 580, 590 in both FIG. 5B and FIG. 5C. Further, it should be noted that sides of fixture 550 are not visible from the front or the sides. However, fixture 550 would be visible from the back side if the back panel including the back side of fixture 550 is used as well.

Figure 6A:
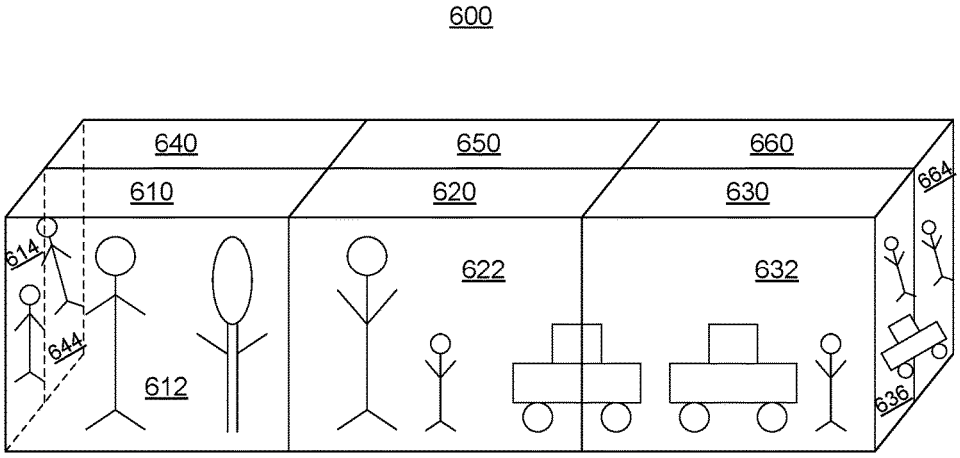
FIG. 6A is a functional diagram of a modular promotional unit formed with multiple fixtures in accordance with one implementation of the present disclosure.

FIG. 6A is a functional diagram of a modular promotional unit 600 formed with multiple fixtures 610, 620, 630, 640, 650, 660 in accordance with one implementation of the present disclosure. In the illustrated implementation of FIG. 6A, the modular unit 600 displays each promotion on three panels. The first panel is formed with sides 612, 622, 632 of fixtures 610, 620, 630, respectively. The second panel is formed with sides 614, 644 of fixtures 610, 640, respectively. The third panel is formed with sides 636, 664 of fixtures 630, 660, respectively.

Figure 6B:
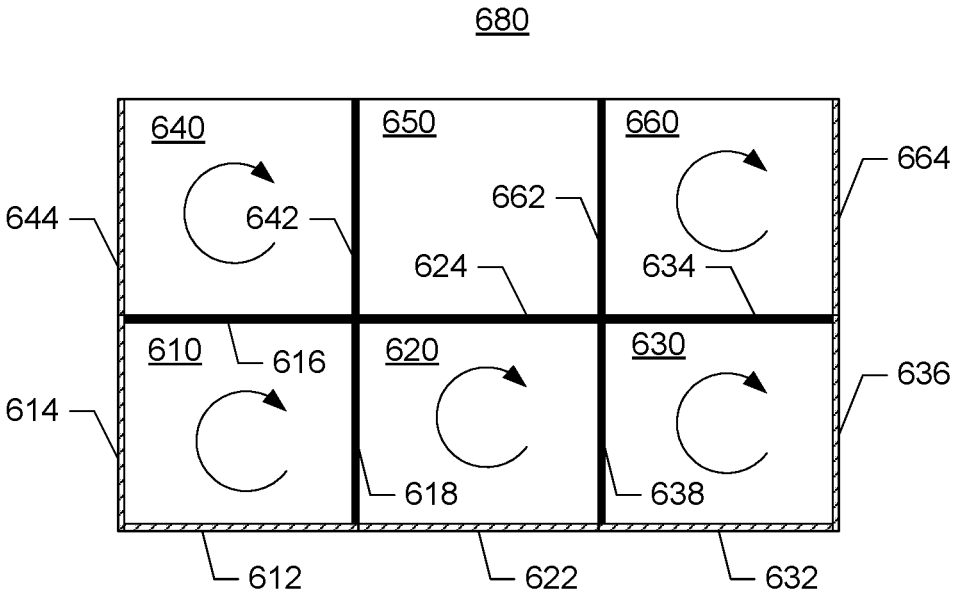
FIG. 6B shows a top view of a first promotion which includes three panels with certain sides visible.

FIG. 6B shows a top view of a first promotion 680 which includes three panels with sides 612, 622, 632, 614, 644, 636, 664 visible. In FIG. 6B, fixtures 620, 640, 660 use two sides, one for each promotion. Fixture 620 uses side 622 for the first promotion and side 624 for the second promotion. Fixture 640 uses side 644 for the first promotion and side 642 for the second promotion. Fixture 660 uses side 664 for the first promotion and side 662 for the second promotion. Further, in FIG. 6B, fixture 610 uses four sides, two for each promotion. Sides 612, 614 are used for the first promotion, while sides 616, 618 are used for the second promotion. Thus, sides 612, 622, 632 comprise a front-facing panel, while sides 614, 644 comprise a left side-facing panel and sides 636, 664 comprise a right side-facing panel.

Figure 6C:
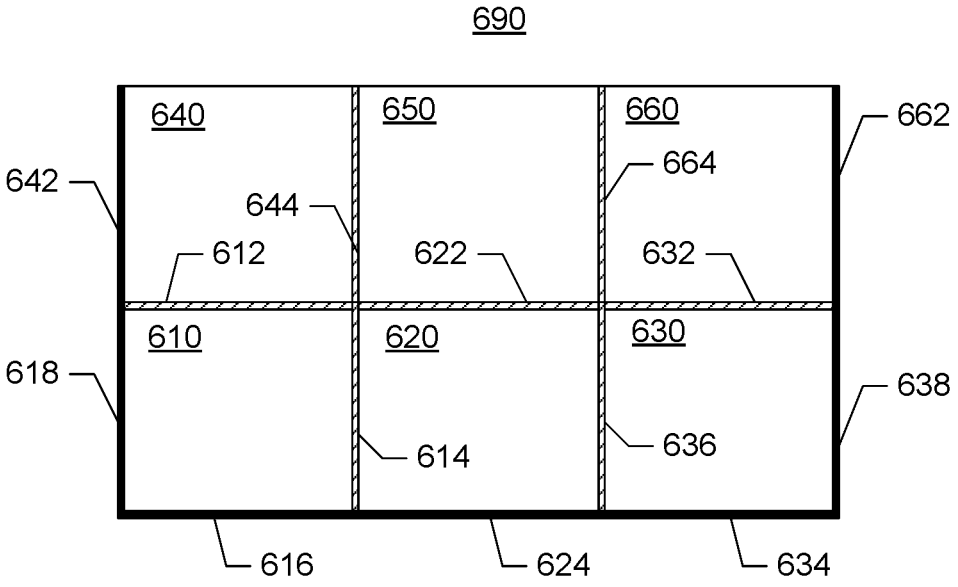
FIG. 6C shows a top view of a second promotion which includes three panels with different sides visible.

FIG. 6C shows a top view of a second promotion 690 which includes three panels with sides 616, 624, 634, 618, 642, 638, 662 visible. Thus, sides 616, 624, 634 comprise a front-facing panel, while sides 618, 642 comprise a right side-facing panel and sides 638, 662 comprise a left side-facing panel.

To convert the first promotion 680 to the second promotion 690, fixtures 610, 620, 630, 640, 660 are rotated 180 degrees. Fixture 620 is rotated 180 degrees so that side 622, which was visible in FIG. 6B as part of the front-facing panel is hidden in FIG. 6C, while side 624, which was hidden in FIG. 5B, is shown in FIG. 5C as part of the front-facing panel. Fixture 640 is rotated 180 degrees so that side 644, which was visible in FIG. 6B as part of the left side-facing panel is hidden in FIG. 6C, while side 642, which was hidden in FIG. 6B, is shown as part of the left side-facing panel in FIG. 6C. Fixture 660 is rotated 180 degrees so that side 664, which was visible in FIG. 6B as part of the right side-facing panel is hidden in FIG. 6C, while side 662, which was hidden in FIG. 6B, is shown in FIG. 6C as part of the right side-facing panel. Fixture 610 is rotated 180 degrees so that sides 612, 614, which were visible in FIG. 6B as part of the front-facing (612) and left side-facing (614) panels are hidden in FIG. 6C, while sides 616, 618, which were hidden in FIG. 6B, are shown in FIG. 6C as part of the front-facing (616) and left side-facing (618) panels. Fixture 630 is rotated 180 degrees so that sides 632, 636, which were visible in FIG. 6B as part of the front-facing (632) and right side-facing (636) panels are hidden in FIG. 6C, while sides 634, 638, which were hidden in FIG. 6B, are shown in FIG. 6C as part of the front-facing (634) and right side-facing (638) panels.

Figure 7:
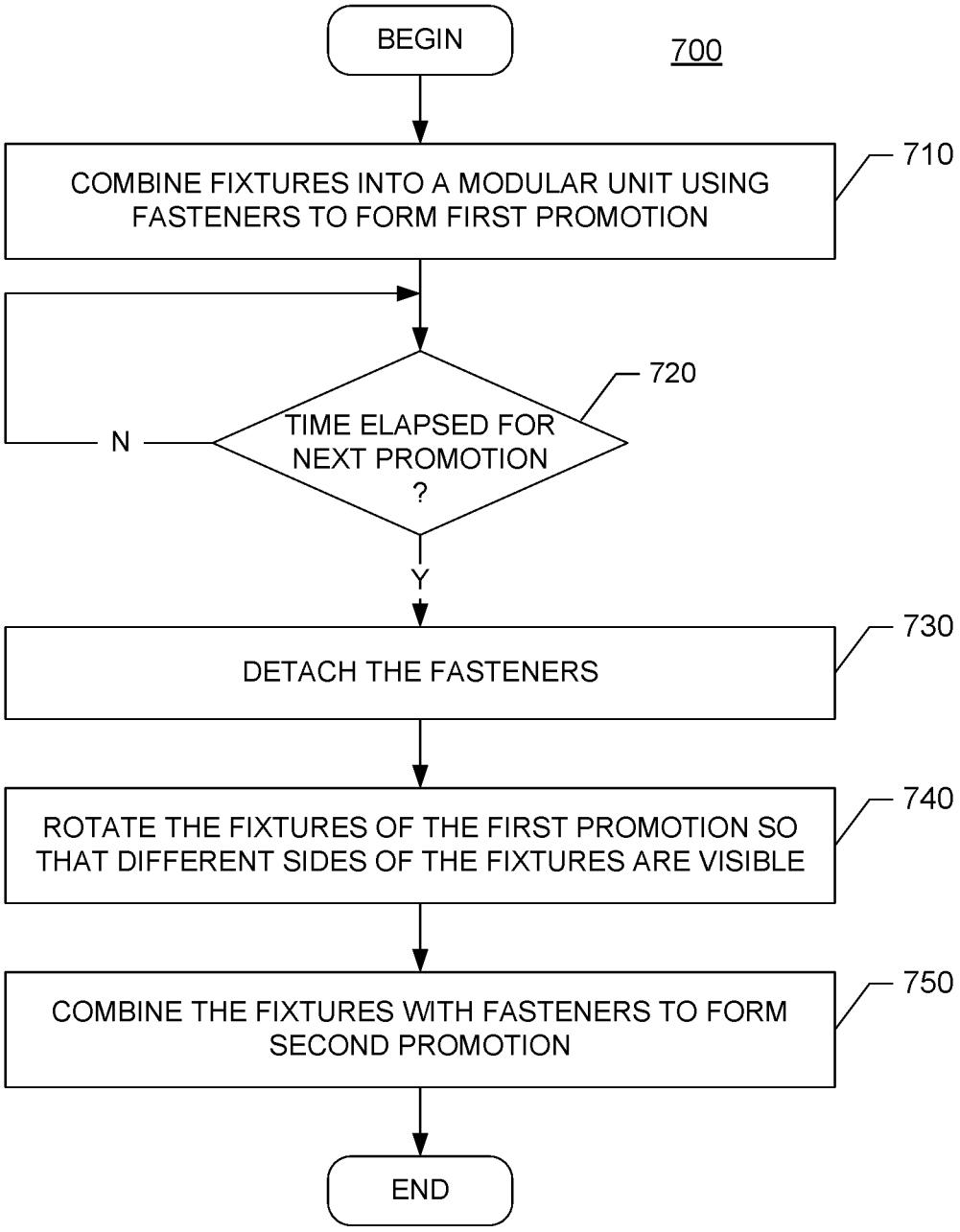
FIG. 7 is a flow diagram illustrating a process for reconfiguring a plurality of fixtures to show multiple promotions in accordance with one implementation of the present disclosure.

FIG. 7 is a flow diagram illustrating a process 700 for reconfiguring a plurality of fixtures to show multiple promotions in accordance with one implementation of the present disclosure. In the process 700, fixtures are combined into a modular unit using fasteners to form a first promotion, at block 710. A determination is made, at block 720, whether a predetermined period of time for displaying the first promotion has elapsed. In one implementation, the predetermined period of time is two weeks. Once the predetermined period of time has elapsed (i.e., the determination at block 720 resulted in a positive output), the fasteners are detached, at block 730, and the fixtures of the first promotion are rotated, at block 740, so that different sides of the fixtures are visible. Otherwise, the promotion stays on the first promotion (at block 720) until the predetermined period of time is reached.

The rotation of the fixture is configured so that the center of rotation does not have to be moved significantly. Thus, the term "not . . . significantly" refers to a movement within a limited space in which the promotion is being displayed. Further, the change in configuration from the first promotion to the second promotion is such that the position of each fixture within the first or second promotion is made to remain constant. This enables the change in configuration to be made without having to shuffle the fixtures in a limited space. The fixtures are then combined again with fasteners, at block 750, into another modular unit to form a second promotion.

The foregoing methods and apparatus are susceptible to many variations. For example, although the specification describes promotions with two and three panels, the promotions can be configured with more than three panels. The configurations of promotions with more than three panels can be ascertained by extending the descriptions for the two- and three-panel configurations. Further, other configurations for the promotions are contemplated. For example, the illustrations in the present disclosure show only one row of panels. However, additional rows of panels can be stacked on top of the present row of panels. Additionally, for clear and brief description, many descriptions of the methods and apparatus have been simplified. Many descriptions use terminology and structures of specific standards. However, the disclosed methods and apparatus are more broadly applicable.

Those of skill in the art will appreciate that the various illustrative logical blocks, modules, units, and algorithm steps described in connection with the implementations disclosed herein can often be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular constraints imposed on the overall system. Skilled persons can implement the described functionality in varying ways for each particular system, but such implementation decisions should not be interpreted as causing a departure from the scope of the disclosure. In addition, the grouping of functions within a unit, module, block, or step is for ease of description. Specific functions or steps can be moved from one unit, module, or block without departing from the disclosure.

The above description of the disclosed implementations is provided to enable any person skilled in the art to make or use the disclosure. Various modifications to these implementations will be readily apparent to those skilled in the art, and the generic principles described herein can be applied to other implementations without departing from the spirit or scope of the disclosure. Accordingly, the techniques are not limited to the specific examples described above. Thus, it is to be understood that the description and drawings presented herein represent a presently preferred implementation of the disclosure and are therefore representative of the subject matter that is broadly contemplated by the present disclosure. It is further understood that the scope of the present disclosure fully encompasses other implementations that may become obvious to those skilled in the art and that the scope of the present disclosure is accordingly limited by nothing other than the appended claims.

The invention claimed is:

1. A reconfigurable module for displaying a plurality of promotions, the reconfigurable module comprising:

a plurality of fixtures sequentially reconfigurable into the plurality of promotions by rotating at least one fixture while maintaining an original position of each fixture within the reconfigurable module, each fixture including a plurality of sides, wherein each promotion of the plurality of promotions has a plurality of panels, and each panel includes at least two of the plurality of sides, wherein fixtures at intersections of two panels use first and second adjacent sides for one promotion of the plurality of promotions and third and fourth adjacent sides for a next promotion of the plurality of promotions, and each of the remaining fixtures having one panel showing for each promotion use one side for the one promotion and an opposite side for the next promotion, wherein the sequential re-configuration includes the rotating the at least one fixture during a transition from the one promotion to the next promotion; and a plurality of fasteners to combine the plurality of fixtures into the reconfigurable module.

2. The reconfigurable module of claim 1, wherein at least one side of the plurality of sides is arranged on at least one outer panel of the reconfigurable module.

3. The reconfigurable module of claim 2, wherein the at least one side is visible to a viewer of the reconfigurable module.

4. The reconfigurable module of claim 3, wherein the at least one side visible to the viewer during the one promotion of the plurality of promotions is hidden in the next promotion of the plurality of promotions.

5. The reconfigurable module of claim 4, wherein the reconfigurable module is reconfigured from the one promotion to the next promotion after a predetermined period of time has elapsed.

6. The reconfigurable module of claim 3, wherein the at least one side hidden during the one promotion of the plurality of promotions is visible to the viewer in the next promotion of the plurality of promotions.

7. The reconfigurable module of claim 1, wherein the plurality of fasteners comprises at least one of tapes, ridges, holes, Velcro pads, hooks, tabs, and pins.

8. The reconfigurable module of claim 1, wherein each fixture is a corrugate box containing a media item of a movie being promoted.

9. The reconfigurable module of claim 1, wherein each fixture is a corrugate stand displaying multiple promotions on multiple sides.

10. A module reconfigurable from a first promotion to a second promotion, the module comprising:

a plurality of fixtures sequentially reconfigurable from the first promotion to the second promotion by rotating at least one fixture, wherein the sequential re-configuration includes the rotating the at least one fixture during a transition from the first promotion to the second promotion, wherein a position of each fixture within the module is maintained from the first promotion to the second promotion, wherein each promotion of the plurality of promotions has a plurality of panels, and each panel includes a plurality of sides, wherein fixtures at intersections of two panels use first and second adjacent sides for the first promotion and third and fourth adjacent sides for the second promotion, and each of the remaining fixtures having one panel use one side for the first promotion and an opposite side for the second promotion; and a plurality of fasteners to couple the plurality of fixtures together in the first promotion and the second promotion.

11. The module of claim 10, wherein at least one side of each fixture is visible to a viewer of the module during the first promotion or the second promotion.

12. The module of claim 10, wherein each fixture is a corrugate cube containing media items which are being promoted.

13. The module of claim 10, wherein each fixture is a corrugate stand displaying multiple promotions on multiple sides.

14. A method of reconfiguring a plurality of fixtures to display at least first and second promotions, the method comprising:

arranging the plurality of fixtures into a modular unit using fasteners to form a first promotion, the plurality of fixtures sequentially reconfigurable from the first promotion to the second promotion; and rotating at least one fixture of the plurality of fixtures of the first promotion such that different sides of the plurality of fixtures are visible for the second promotion, wherein the rotating of the at least one fixture for the second promotion is done during a transition from the first promotion to the second promotion, wherein each promotion of the first and second promotions has a plurality of panels, and each panel includes a plurality of sides, wherein fixtures at intersections of two panels use first and second adjacent sides for the first promotion and third and fourth adjacent sides for the second promotion, and each of the remaining fixtures having one panel use one side for the first promotion and an opposite side for the second promotion.

15. The method of claim 14, further comprising combining the plurality of fixtures with the fasteners into the modular unit to form the second promotion.

16. The method of claim 14, wherein rotating at least one fixture comprises keeping a position of each fixture within the modular unit fixed.

* * * * *